United States Patent [19]

Fox, III

[11] Patent Number: 4,781,085

[45] Date of Patent: Nov. 1, 1988

[54] LOCKING SOCKET WRENCH EXTENSION

[75] Inventor: Leonard J. Fox, III, San Diego, Calif.

[73] Assignee: Bayfront Investments, Inc., Encinitas, Calif.

[21] Appl. No.: 139,478

[22] Filed: Dec. 30, 1987

[51] Int. Cl.[4] ..... B25B 13/00

[52] U.S. Cl. ..... 81/177.85; 81/177.1

[58] Field of Search ..... 81/177.85, 177.2, 177.1, 81/177.8, 177.9

[56] References Cited

U.S. PATENT DOCUMENTS

| | | | |
|---|---|---|---|
| 1,864,466 | 6/1932 | Peterson | 81/177.85 |
| 4,218,940 | 8/1980 | Main | 81/177.85 |
| 4,297,924 | 11/1981 | Stephens | 81/59.1 |
| 4,367,663 | 1/1983 | Merics | 81/177 A |
| 4,399,722 | 8/1983 | Sardo | 81/60 |
| 4,480,511 | 11/1984 | Nickipuck | 81/177 G |
| 4,502,365 | 3/1985 | Hacker | 81/177 G |
| 4,589,308 | 5/1986 | Palm | 81/177.85 |

*Primary Examiner*—Frederick R. Schmidt
*Assistant Examiner*—Lawrence Cruz
*Attorney, Agent, or Firm*—Calif Kip Tervo

[57] ABSTRACT

An extension for use with the drive member of a socket wrench system includes a shaft having a coupling at its rear end for attaching the rear end to a socket drive member, and a stud at its front end for torque transferring engagement with a socket. A locking mechanism secures a socket to the stud. The locking components are operable between a first position for positively locking a socket to the stud and a second position for releasing a socket. The locking mechanism includes a central bore within the shaft and a radial cavity from the central bore through the stud. A detent in the radial cavity has a locking position wherein it protrudes out of the stud when the locking mechanism is in its locking position so as to engage a socket and prevent its removal from the stud. The detent has a releasing position wherein it resides substantially within the stud and partially within the axial bore. A locking bolt within the axial bore is axially moveable by a thumb lever for activating the detent. The thumb lever and bolt are designed to allow easy attachment of the thumb lever to the bolt.

4 Claims, 1 Drawing Sheet

LOCKING SOCKET WRENCH EXTENSION

BACKGROUND OF THE INVENTION

1. Field of the Invention

This invention relates generally to socket wrenches and more particularly involves a socket wrench extension shaft which is adapted to positively lock sockets in place on the extension.

2. Description of the Related Art

Socket wrenches have become a widely used tool in industry and particularly in the field of automotive repair. In its simplest form, the socket wrench is an elongated device, commonly referred to as a drive, having a stud at one end for mounting a socket. Typically, the drive is a ratchet device, and the stud axis is at a right angle to the drive longitudinal axis. Also, typically, the stud contains a small, spring-loaded detent ball to aid in retaining the socket on the stud. Usually, retaining the socket is not a problem when the socket is attached directly to the drive stud as the user's free hand can hold and manipulate the socket. Also, if the socket does disengage, it is close by and easily retrievable. However, when an extension is used between the drive and the socket, retention of the socket becomes more difficult and more important. There has been a long recognized need in the field for a suitable locking extension.

Heretofore, the several mechanisms to positively lock a socket onto an extension have been proposed. There are a number of disadvantages to these prior art methods, and they not have found receptance in the workplace because they lack one or more of the desirable traits listed below.

For purposes of costs and adaptability, it is desirable that the locking mechanism be easily incorporated into an extension of standard type with a minimum additional manufacturing.

It is desirable that the locking mechanism not increase the girth of the extension. Large or protruding appendages are limited in their placement and catch on surroundings to become accidentally activated.

It is desirable to retain as much strength as possible in the extension by avoiding large surface cuts and channels.

It is desirable that the mechanism be easily disassembled and cleaned, i.e. "field stripped", should it become fouled.

SUMMARY OF THE INVENTION

The invention is a an extension for use with the drive member of a socket wrench system. The extension includes a shaft having a coupling at its rear end for attaching the rear end to a socket drive member, and a stud at its front end for torquetransferring engagement with a socket. A locking mechanism secures a socket onto the stud. The locking components are operable between a first position for positively locking a socket to the stud and a second position for releasing a socket.

DETAILED DESCRIPTION OF THE INVENTION

Figure 1:
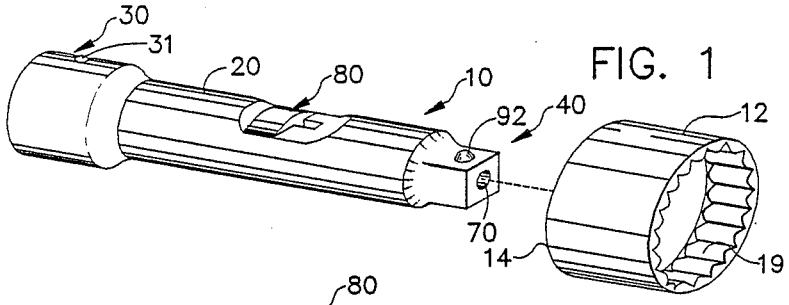
FIG. 1 is a perspective view of the locking socket wrench extension of the present invention and a standard socket.

With reference now to the drawing, and more particularly to FIG. 1 thereof, there is shown a perspective view of a prefered embodiment of the locking socket wrench extension, denoted generally as 10, of the current invention and a common socket 12.

Figure 3:
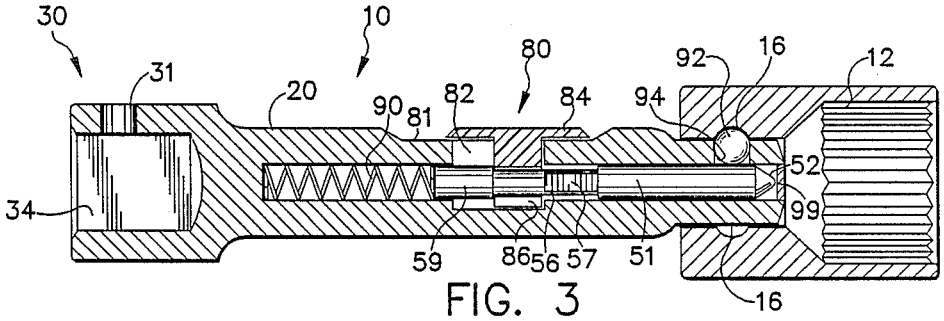
FIG. 3 is an enlarged side cross-sectional view of the extension of FIG. 1.

The socket is best seen and described with respect to FIGS. 1 and 3. On the rear end of socket 12 is longitudinal cavity 14, and on its front end is work-piece engaging means, such as protruding teeth 19. Standard sockets have an indented cavity ring 16 disposed off longitudinal cavity 14 for receiving a portion of a spring biased detent ball located in the driver stud. It will be seen that the invention will function with sockets having either of these detent receiving means and will also strongly secure sockets not having these features.

Figure 4:
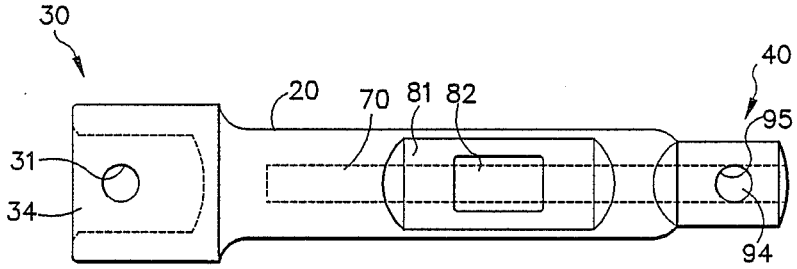
FIG. 4 is is a top view of the extension shaft body of FIG. 3 without the locking components.

With reference once more to FIG. 1, locking extension 10 has a rear end, denoted generally as 30, which is suitable for connection to the drive of a standard socket wrench (not shown). As seen in FIGS. 3 and 4, rear end 30 includes longitudinal cavity 34 for receiving a drive stud and a radial hole 31 for accepting a detent. Shaft 20 connects rear end 30 with socket receiving means, such as the front end or stud, denoted generally as 40. Stud 40 is of standard size for insertion into longitudinal cavity 14 of socket 12 for transfering torque to socket 12.

As best illustrated in FIG. 4, an axial bore 70 in shaft 20 extends thru stud 40, exiting at exit orifice 71. Two radial holes pass from axial bore 70 to the extension's surface: radial cavity 94 terminating in circular opening 95, and thumb lever slot or channel 82.

The component for engaging and positively locking socket 12 onto stud 40 consists of detent means, such as ball 92, that is disposed in radial cavity 94 below circular opening 95. The diameter of ball 92 is slightly greater than the circular opening 95 such that ball 92 can extend only partially out of the opening. Of course, ball 92 could be replaced by any of numerous other types of detents which could be designed to protrude out of stud 40 and which are adaptable to the present invention.

Figure 2:
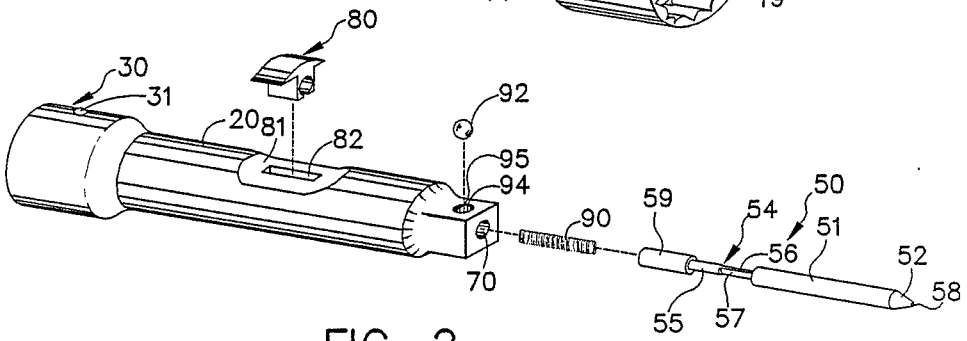
FIG. 2 is an exploded view of the invention of FIG. 1.

As best seen in FIG. 3, an axially moveable locking bolt 50 is disposed in axial bore 70. Locking bolt 50 (see also FIGS. 2 and 6) has a front section 51, middle section 54, and rear section 59. Front section 51 includes a slanted section for engaging and moving ball 92 out of axial bore 70 into its locking position protruding from stud 40 and a truncated tip 58 so that it will reside within stud 40.

Middle section 51 includes thumb lever receiving section 56 and thumb lever journal 55. Spring 90, under compression, is disposed in axial bore 70 and bears against the rear section 59 of locking bolt 50 to forward bias it. Rear section 59 is of larger diameter than journal 55. The functions of these components will be explained shortly.

Figure 5:
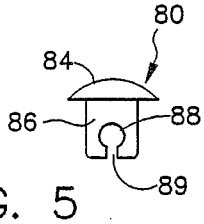
FIG. 5 is an end plane view of the thumb lever of FIG. 3.
Figure 6:
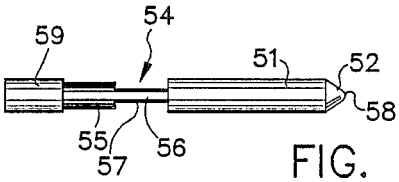
FIG. 6 is a top view of the locking bolt of FIG. 3.

FIG. 5 is an end view of thumb lever 80. Thumb lever 80 is disposed in thumb lever channel 82 and has an inner end 86 for engagement with the journal 55 of locking bolt 50 such that the thumb lever cannot be withdrawn from the thumb lever channel 82. Inner end 86 includes a bore 88 for accommodating journal 55 and an entry slot 89 for permitting insertion of the receiving section 56 of the locking bolt 50. FIG. 6 is a top view of a prefered embodiment of locking bolt 50. Locking bolt middle section 54 is of diameter equal to the thumb lever bore 88. The forward part of the middle section, thumb lever receiving section 56 has shaved off side walls 57 so that it slide thru the thumb lever entry slot 89. Instead of cutaway side walls, receiving section 57 could be of small diameter.

The top 84 of thumb lever 80 covers channel 82 at all times to prevent entry of debris.

As best seen in FIG. 3, a recess 81 on shaft 20 surrounds the thumb lever exit such that the thumb lever top 84 resides within line continuing the circumference of the shaft 20. Thumb lever top 84 (FIG. 5) is rounded to fit within the curvature of shaft 20, thereby preventing the thumb lever from being accidentally activated during use. It should be noted that no components of the invention are outside of the outside perimeter of shaft 20.

The locking socket wrench extension 10 of the present invention is easily manufactured from conventional extensions by machining axial bore 70 and thumb lever channel 82 and recess 81. The locking extension is easily assembled. Spring 90 is inserted thru orifice 71 into axial bore 70, followed by locking bolt 50. Using a short stick or the like to push on bolt tip 58, bolt 50 is pushed into axial bore 70 compressing spring 90 until the thumb lever receiving section 57 is positioned below thumb lever channel 82. Thumb lever 80 is inserted in channel 82 and entry slot 89 slides over receiving section 57. Upon release, biasing spring 90 pushes bolt 50 forward, the journal 55 moves into bore 88, and the front of rear section 59 engages the rear side of thumb lever 80. Bolt 50 and thumb lever 80 move forward until the front of the thumb lever encounters the front wall of channel 82. Detent ball 92 can be pre-inserted into cavity 94 or inserted at time time and the opening 95 can then be compression closed. Cover 99 may be used to plug orifice 71 for preventing entry of debris.

FIG. 3 illustrates the ordinary locked disposition of the invention with spring 90 forward biasing bolt 50 and thumb lever 80, and with ball 92 bearing on the outside surface of front section 51 and protruding from stud 40 to enter indented ring 16 of socket 12 for positively locking the socket onto the extension 10. Movement of thumb lever 80, and hence bolt 50, rearward to the release position allows ball 92 to move down slant 52 until it no longer protrudes from stud 40, and socket 12 can be attached or removed. Release of thumb lever 80 moves bolt 50 forward and ball 92 up slant 52 to the locked position.

Although a particular embodiment of the invention has been illustrated and described, various changes may be made in the form, construction, and arrangement of the parts herein without sacrificing any of its advantages, and it is intended to cover in the appended claims such modifications and changes as come within the true spirit and scope of the invention.

I claim:

1. In an extension for use with the drive member of a socket wrench system comprising a shaft of predetermined length having a rear end and a front end, coupling means at said shaft rear end for coupling said rear end to a socket drive member, and receiving means at said shaft front end for torque transferring engagement with a socket; locking means for securing a socket onto said receiving means, said locking means being operable between a first position for positively locking a socket to the engagement means and a second position for releasing a socket; said locking means comprising:

a central bore within said shaft;

a radial cavity from said central bore thru said receiving means;

a thumb lever channel extending radially from said central bore;

a detent disposed in said radial cavity in said socket receiving means, said detent having a locking position wherein it protrudes out of said receiving means when the locking means is in its locking position so as to engage a socket and prevent its removal from said receiving means, and said detent having a releasing position wherein it resides substantially within said receiving means with a portion of said detent disposed within said central bore when said locking means is in its releasing position;

a locking bolt within said central bore including:

a front section;

a thumb lever receiving section; and a thumb lever journal section;

said bolt being axially moveable such that as said bolt is moved from a release position to a locking position, its said front section contacts and moves said detent from its release position to its locking position;

biasing means for biasing said bolt in the locking position; and a thumb lever disposed in said channel; said thumb lever having an inner end for engagement with said locking shaft and an outer end accessable by a person's thumb for axial movement for moving said bolt from its locking position to its release position; said thumb lever inner end including:

a bore for attachment around said journal section; and an entry slot to said bore for passage therethru of said receiving section for attachment of said thumb lever to said locking bolt; and engaging means for engaging said bolt and thumb lever for axial movement of said bolt.

2. The extension of claim 1 wherein said shaft is recessed around the outer opening of said thumb lever channel, and said thumb lever outer end is contoured so as to be within the pre-recess shaft area.

3. The extension of claim 1 wherein said thumb lever top completely covers said channel during operation.

4. The extension of claim 1 wherein said bolt and thumb lever engaging means comprises:

a rear section on said locking bolt adjacent said journal section and of larger diamenter than said thumb lever bore.

* * * * *